US007513979B2

(12) United States Patent
Le Hervet et al.

(10) Patent No.: US 7,513,979 B2
(45) Date of Patent: Apr. 7, 2009

(54) SERIES OF ELECTROLYSIS CELLS FOR THE PRODUCTION OF ALUMINIUM COMPRISING MEANS FOR EQUILIBRATION OF THE MAGNETIC FIELDS AT THE ENDS OF THE LINES

(75) Inventors: Morgan Le Hervet, Saint Jean de Maurienne (FR); Nicolas Ligonesche, Saint Folquin (FR)

(73) Assignee: Aluminium Pechiney, Voreppe (FR)

( * ) Notice: Subject to any disclaimer, the term of this patent is extended or adjusted under 35 U.S.C. 154(b) by 365 days.

(21) Appl. No.: 10/599,586

(22) PCT Filed: Mar. 30, 2005

(86) PCT No.: PCT/FR2005/000758

§ 371 (c)(1),
(2), (4) Date: Oct. 2, 2006

(87) PCT Pub. No.: WO2005/098094

PCT Pub. Date: Oct. 20, 2005

(65) Prior Publication Data

US 2007/0205099 A1 Sep. 6, 2007

(30) Foreign Application Priority Data

Apr. 2, 2004 (FR) ..... 04 03501

(51) Int. Cl.
*C25C 3/16* (2006.01)
*C25C 3/12* (2006.01)

(52) U.S. Cl. ..... 204/244; 204/247.1; 204/243.1

(58) Field of Classification Search ..... 204/243.1, 204/244, 247.1
See application file for complete search history.

(56) References Cited

U.S. PATENT DOCUMENTS 3,775,280 A * 11/1973 Nikiforov et al. ..... 204/244

(Continued)

FOREIGN PATENT DOCUMENTS

EP 0342033 A 11/1989

(Continued)

OTHER PUBLICATIONS

Russian Office Action for RU 2006138623 dated Dec. 18, 2008.

*Primary Examiner*—Bruce F Bell
(74) *Attorney, Agent, or Firm*—Banner & Witcoff, Ltd.

(57) ABSTRACT

The invention relates to a series (1) of electrolysis cells for the production of aluminum by fusion electrolysis, comprising at least two lines of cells, arranged transversely, an internal correction circuit (200) with at least one internal correction conductor (20, 20') per line, adjacent to the neighboring line and a main connection circuit (400) between the final cells of the lines (101, 101'). In at least one line, the main connection circuit (400) comprises a layer of conductors, each conductor of which extends from the end of the final cell of the line to a given distance (D2, D2') therefrom and the internal correction circuit (200) comprises a section of transverse conductors, arranged at a given distance (D1, D1') from the final cell (101, 101') running along the final cell for a given part L of the length thereof Lo. The invention permits a reduction in the mean supplementary vertical fields to very low values for electrolysis currents of a value greater than 300 kA.

20 Claims, 5 Drawing Sheets

U.S. PATENT DOCUMENTS

| | | | | | |
|---|---|---|---|---|---|
| 4,072,597 | A | * | 2/1978 | Morel et al. | 205/347 |
| 4,132,621 | A | * | 1/1979 | Morel et al. | 205/347 |
| 4,169,034 | A | * | 9/1979 | Morel et al. | 204/279 |
| 4,200,513 | A | * | 4/1980 | Morel et al. | 204/279 |
| 4,211,626 | A | * | 7/1980 | Kaluzhsky et al. | 204/244 |
| 4,396,483 | A | | 8/1983 | Schmidt-Hatting | |
| 4,683,047 | A | | 7/1987 | Boivin et al. | |
| 4,696,730 | A | * | 9/1987 | Chaffy et al. | 204/244 |
| 4,713,161 | A | * | 12/1987 | Chaffy et al. | 204/244 |
| 4,976,841 | A | * | 12/1990 | Boivin et al. | 204/244 |
| 6,551,473 | B1 | * | 4/2003 | Gaillard et al. | 204/244 |
| 2005/0067298 | A1 | * | 3/2005 | DelClos et al. | 205/337 |
| 2007/0256930 | A1 | * | 11/2007 | Linnerud et al. | 204/267 |
| 2008/0041718 | A1 | * | 2/2008 | Pingin et al. | 204/242 |

FOREIGN PATENT DOCUMENTS

| | | | |
|---|---|---|---|
| FR | 2583069 | A | 12/1986 |
| GB | 2020700 | | 11/1979 |
| RU | 2060304 | C1 | 10/1989 |
| RU | 2168564 | C2 | 3/1999 |

* cited by examiner

SERIES OF ELECTROLYSIS CELLS FOR THE PRODUCTION OF ALUMINIUM COMPRISING MEANS FOR EQUILIBRATION OF THE MAGNETIC FIELDS AT THE ENDS OF THE LINES

CROSS REFERENCE TO RELATED APPLICATIONS

This application claims, under 35 U.S.C. §119, the benefit of priority of the filing date of Patent Cooperation Treaty patent application, Serial Number PCT/FR2005/000758, filed on Mar. 30, 2005, which is incorporated herein by reference, wherein Patent Cooperation Treaty patent application Serial Number PCT/FR2005/000758 was not published under PCT Article 21(2) in English.

This application also claims, under 35 U.S.C. §119, the benefit of priority of the filing date of French patent application, Application No. FR 0403501, filed on Apr. 2, 2004, which is incorporated herein by reference.

FIELD OF THE INVENTION

The invention relates to the production of aluminum by means of fused bath electrolysis, i.e., by means of electrolysis of alumina dissolved in a molten cryolite bath, referred to as an electrolytic bath, according to the well-known Hall-Heroult process. The invention particularly relates to the equilibration of the magnetic field of series of rectangular electrolytic cells arranged transversally.

BACKGROUND OF THE RELEVANT ART

The plants for the production of aluminium by fused bath electrolysis contain a large number of electrolytic cells—typically several hundred—arranged in lines, and connected electrically in series using connecting conductors, so as to form two or more parallel lines which are connected together electrically by connecting conductors. The cells, which are rectangular in shape, can be oriented either longitudinally (i.e., such that their main axis is parallel with the main line axis), or transversally (i.e., such that their main axis is perpendicular to the main line axis).

The line arrangement of the electrolytic cells offers the advantage of simplifying the configuration of the connecting conductors and making the magnetic field map uniform. However, the presence of connecting conductors between the lines interferes with the uniformity of the magnetic fields of the end cells of each line.

Equilibration of magnetic fields of series of cells in an economical and satisfactory manner would be beneficial. Therefore, the applicant researched economically and technically satisfactory ways to equilibrate the magnetic fields of series of cells formed from long rectangular cells, arranged transversally, equipped with a correction conductor along the internal side of the lines and designed for intensities greater than 300 kA.

SUMMARY OF EMBODIMENTS OF THE INVENTION

Embodiment of the invention relates to a series of electrolytic cells intended for the production of aluminium by means of fused bath electrolysis according to the Hall-Heroult process, comprising:

at least two lines of cells that are rectilinear and parallel with each other, wherein the cells are arranged transversally with a constant center distance Eo between the cells;

a so-called "internal" correction circuit, comprising, for each line, at least one internal correction conductor, located along the line on the side thereof facing the neighboring line;

a so-called "external" correction circuit, comprising, for each line, at least one external correction conductor, located along the line on the side thereof opposite the neighboring line;

a so-called "main" connecting circuit between the end cell of one line and the corresponding end cell of the other line, and characterised in that, for at least one line:

the main connecting circuit comprises a layer of conductors wherein each conductor extends from the end cell of the line to a determined distance (D2 and/or D2') from the main axis C thereof, said distance (D2, D2') being preferentially at least equal to once the center distance Eo, the internal correction circuit also comprises a substantially rectilinear conductor, referred to as the "transverse segment", which is arranged perpendicularly with respect to the longitudinal axis of the line and located at a determined distance (D1 and/or D1') from the end cell of the line, and which runs along said end cell over a determined fraction L of the length Lo of this cell.

Embodiments of the present invention are based in part on the finding that, in the absence of magnetic field equilibration means, the line end cells are particularly affected by an additional mean vertical magnetic field ΔBz. The invention is thus intended to maintain the additional vertical field ΔBz within a range limited by a minimum value and a maximum value around a target value close to zero.

Embodiments of the present invention are also based in part on the finding that the perturbation of the magnetic field map of the end cells of a line stemmed not only from the connecting conductors between the lines, but also the interruption of continuity and symmetry at the end of the lines.

Embodiments of the present invention are further based on the ideas of equipping the series with a layer of conductors capable of simulating the presence of electrolytic cells beyond the end cell, and of introducing said transverse segment, at the end of the line, in order to compensate the magnetic field produced by the connecting conductors between the lines. The combination of these means makes it possible to equilibrate the magnetic fields at the pots of the electrolytic cells located at the connection end of a line (typically about the first 10 cells), i.e., correct the unfavorable magnetic field map produced by the connecting conductors. This combination particularly makes it possible to limit the vertical magnetic field Bz substantially in these cells. In addition, the use of a transverse segment in the internal correction circuit enables a more precise adjustment of the correction thanks to the additional adjustable parameters provided.

FIGURES

The invention is described in detail hereinafter using the appended figures.

DETAILED DESCRIPTION OF EMBODIMENTS OF THE INVENTION

Figure 1:
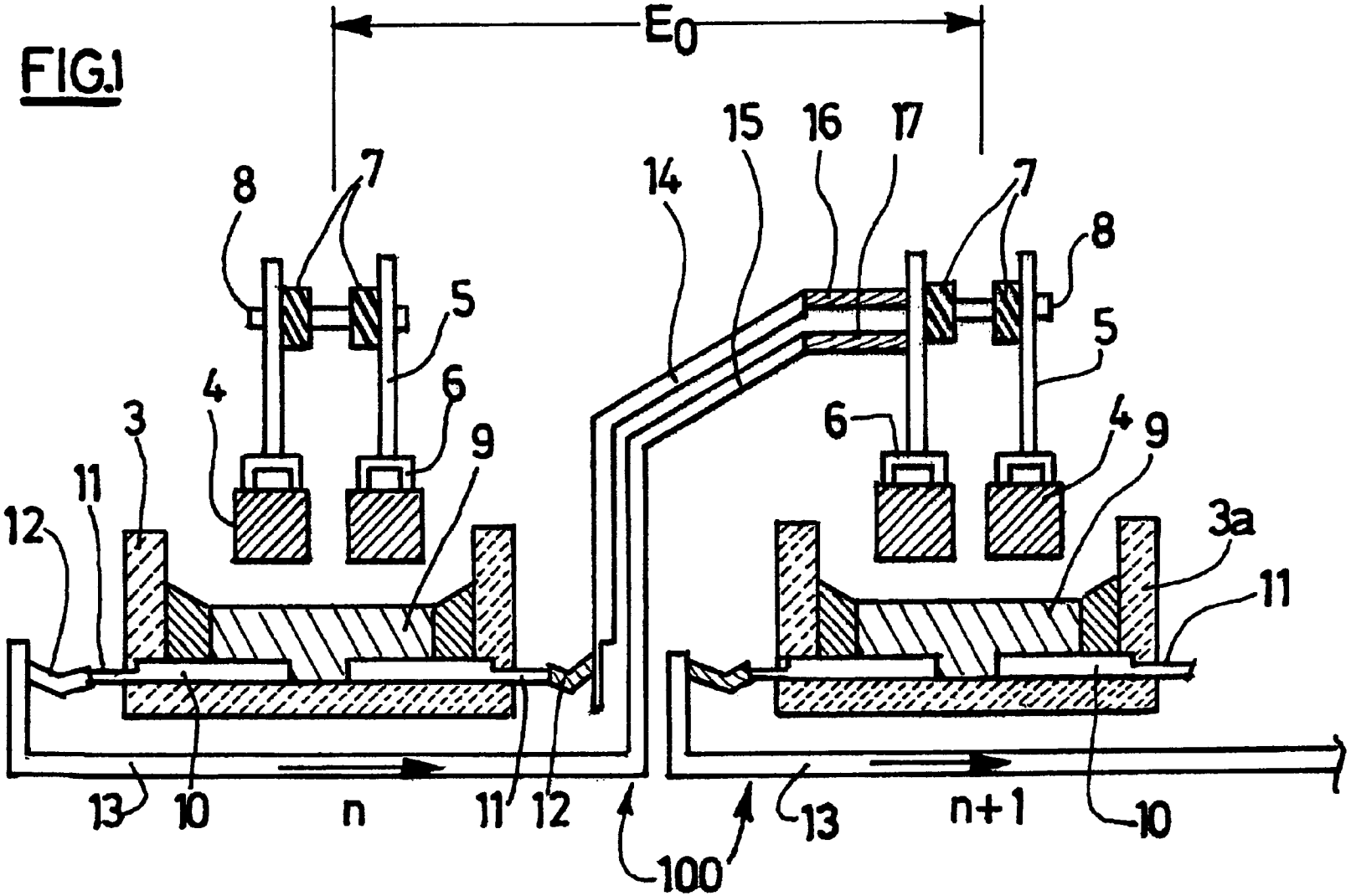
FIG. 1 represents, in a simplified manner and in a cross-sectional view, two typical successive electrolytic cells in a cell line.

Embodiments of the invention relates to series of electrolytic cells 1 comprising, as shown in FIG. 1, a plurality of electrolytic cells 101, 102, . . . 101', 102' substantially rectangular in shape, which are arranged so as to form at least two lines F, F' of parallel substantially rectilinear cells, having each a longitudinal axis A, A'.

In the figures, the electrolytic cells are designated by a reference number which increases from the line end cell. In this way, the end cell (or "first" cell) of each line is designated by the references 101 and 101', the "second" cell by the references 102 and 102', the "third" cell by the references 103 and 103', and so on.

The cells 101, 102, . . . 101', 102', . . . are arranged transversally (i.e., such that their "main axis" C is perpendicular to the main axis A, A' of said lines) and located at the same distance from each other, thus defining a constant center distance Eo between the main axes C of the adjacent cells of each line. The center distance Eo is typically between 5 and 8 meters. The main axis C of the electrolytic cells 101, 102, . . . 101', 102' . . . can be defined as being the axis of symmetry which is parallel with their long sides 18*a*, 18*b*. The long sides 18*a*, 18*b* of each cell 101, 102, . . . 101', 102', . . . have a length Lo and the short sides 19*e*, 19*i* a width Ro. The length Lo can be substantially greater than the width Ro. The cells of the series according to the invention typically have a length Lo greater than three times the width Ro.

The lines F, F' are separated by a distance Do, the value of which depends on technological choices which particularly account for the current intensity Io of the series and the conductor circuit configuration. The distance Do is typically between 40 and 100 m.

As illustrated in FIG. 1, in an embodiment, each electrolytic cell 101, 102, . . . 101', 102', . . . of the series 1 typically comprises a pot 3, anodes 4 supported by attachment means typically comprising a stem 5 and a multipod 6 and connected mechanically and electrically to an anode frame 7 using connection means 8. The pot 3 comprises a metal shell, generally reinforced by stiffeners, and a crucible formed by refractory materials and cathode elements arranged inside the shell. The shell generally comprises vertical lateral walls. In operation, the anodes 4, typically made of carbon-containing material, are partially immersed in an electrolytic bath (not shown) contained in the pot. The pot 3 can comprise a cathode assembly 9 equipped with cathode rods 10, typically made of steel, wherein one end 11 emerges from the pot 3 so as to enable an electrical connection to the connecting conductors 12, . . . 17 between cells.

Figure 2:
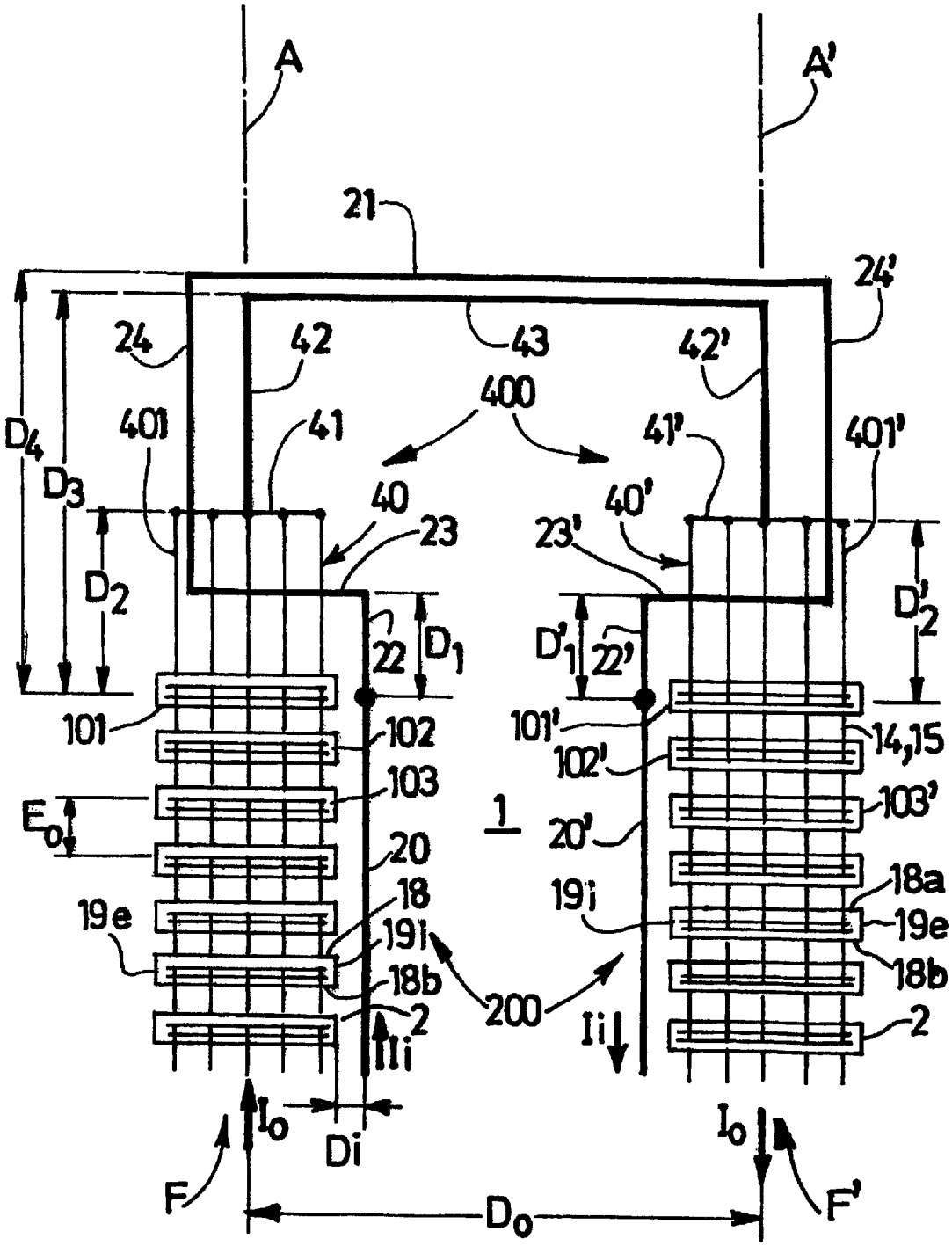
FIG. 2 illustrates, schematically, a series of electrolytic cells according to an embodiment of the invention comprising two lines and an internal correction circuit.
Figure 4:
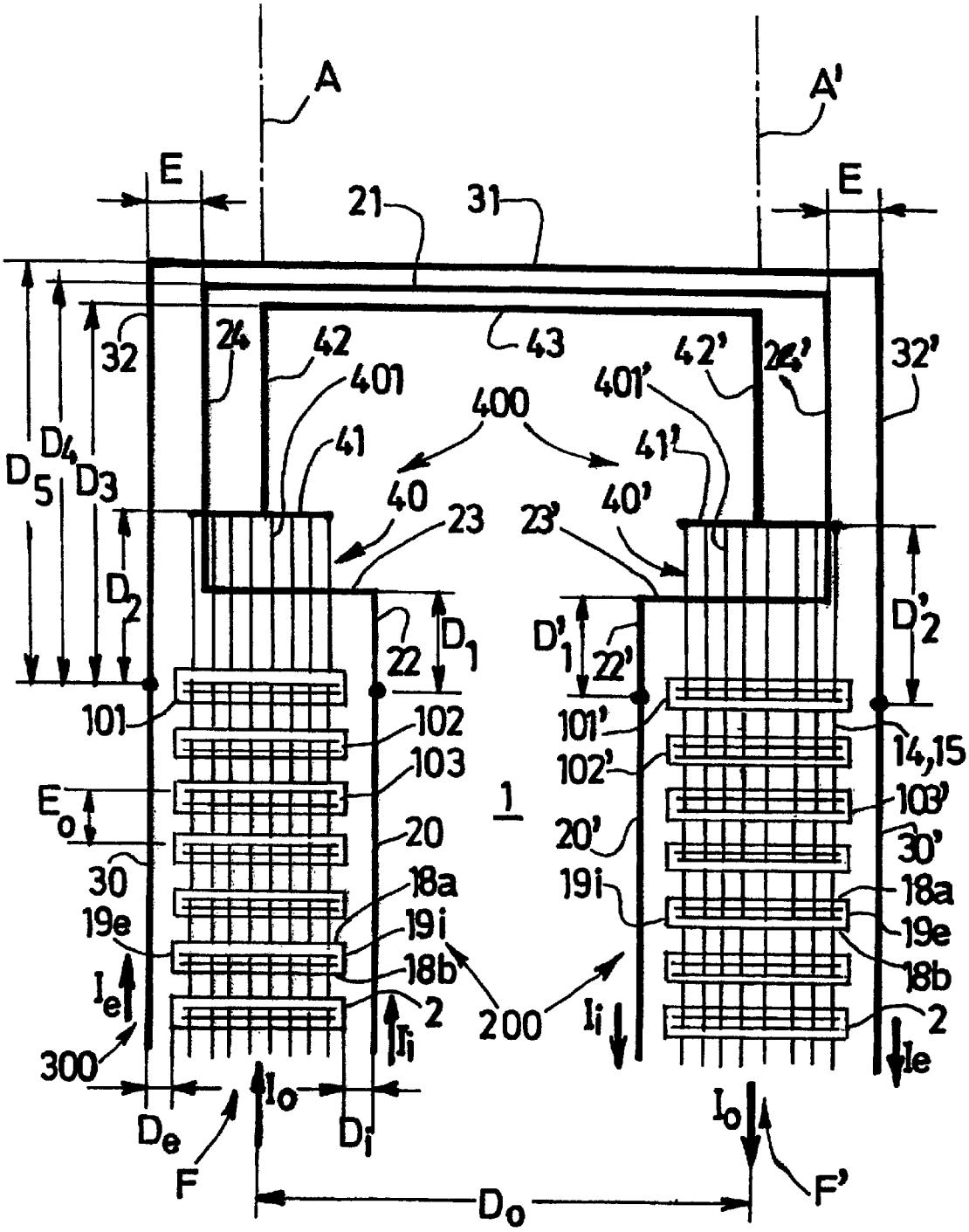
FIG. 4 illustrates, schematically, a series of electrolytic cells according to an embodiment of the invention comprising two lines, an internal correction circuit and an external correction circuit.

The connecting conductors 12, . . . 17 can be connected to said cells 101, 102, . . . 101', 102', . . . so as to form an electrical series, which forms the main electrical circuit 100 of the series of electrolytic cells. The connecting conductors typically comprise flexible conductors 12, 16, 17, upstream connecting conductors 13 and rising sections 14, 15. FIG. 2 illustrates the case of a connecting circuit comprising 5 rising sections (as in French patent application FR 2 552 782). FIG. 4 illustrates the case of a connecting circuit comprising 8 rising sections (as in French patent application FR 2 583 069). The upstream connecting conductors may, completely or partially, pass under the pot and/or bypass it.

The series of electrolytic cells according to an embodiment of the invention also comprises at least one electrical correction circuit independent from the series and running along the so-called "internal" side of the cells, i.e., the side located on the side of the neighboring line. In the embodiment illustrated in FIGS. 2 and 3, the series 1 of cells comprises a single electrical correction circuit 200, refereed to as the "internal circuit". In the embodiment illustrated in FIGS. 4 and 5, the series 1 of cells comprises two electrical correction circuits that are separate and independent from the series, i.e., a first correction circuit, referred to as the "internal circuit" 200, and a second correction circuit, referred to as the "external circuit" 300.

The internal correction circuit 200 can comprises at least one conductor 20, 20' referred to as the "internal correction conductor" and located along each line on the side thereof facing the neighboring line. This conductor is typically substantially rectilinear and parallel with the longitudinal axis A, A' of each line. The circuit also can comprises at least one internal connecting conductor 21 to ensure the electrical continuity between the internal correction conductors 20, 20' of each line. The short side of the cells located on the side of the internal correction conductor 20, 20' is referred to as the internal side 19*i*.

Similarly, the external correction circuit 300 can comprise at least one conductor 30, 30', referred to as the "external correction conductor" and located along each line on the side opposite the neighboring line. This conductor is also typically substantially rectilinear and parallel with the longitudinal axis of each line. The circuit also comprises at least one connecting conductor 31 to ensure the electrical continuity between the external correction conductors 30, 30' of each line. The short side of the cells located on the side of the external correction conductor 30, 30' is referred to as the external side 19*c*.

In operation of an embodiment, the electrolytic current, of an intensity Io, flows in the series 1 of cells and a correction current, of an intensity Ii, flows in the internal correction circuit 200. If the circuit also comprises an external correction circuit, a first correction current, of an intensity Ii, flows in the internal correction circuit 200 and a second correction current, of an intensity Ie, flows in the external correction circuit 300. The direction of these currents is typically that indicated by the corresponding arrows in FIGS. 2 and 4.

In this way, according to an embodiment of the invention, the series 1 of electrolytic cells, which is intended for the production of aluminium by means of fused bath electrolysis according to the Hall-Heroult process, comprises:

- a plurality of electrolytic cells 101, 102, . . . 101', 102' . . . arranged so as to form at least one first F and one second F' lines of cells that are rectilinear and parallel with each other, said cells 101, 102, . . . 101', 102', . . . being arranged transversally with the longitudinal axis A, A' of each line with a constant center distance Eo between the cells, each 101, 102, . . . 101', 102' . . . having a length Lo;
- connecting conductors 12, . . . 17 between the cells of each line;
- a so-called "internal" correction circuit 200, comprising at least one first internal correction conductor 20, located along the first line on the side thereof facing the second line, one second internal correction conductor 20', located along the second line on the side thereof facing the first line, and at least one so-called "internal" connecting conductor 21;

a so-called "main" connecting circuit 400 between the end cell 101 of the first line and the end cell 101' of the second line, and characterised in that, for at least one of said lines:

the main connecting circuit 400 comprises at least one layer of conductors 40, 40' wherein each conductor 401, 401' is connected to the end cell 101, 101' of the line and extends to a determined distance D2, D2' therefrom, the internal correction circuit 200 also comprises at least one rectilinear conductor 23, 23', referred to as the "transverse segment", which is connected to the internal correction conductor 20, 20', is arranged perpendicularly with respect to the longitudinal axis A, A' of the line and runs along the end cell 101, 101' of the line, at a determined distance D1, D1', over a determined portion L of the length Lo of the end cell.

Figure 3:
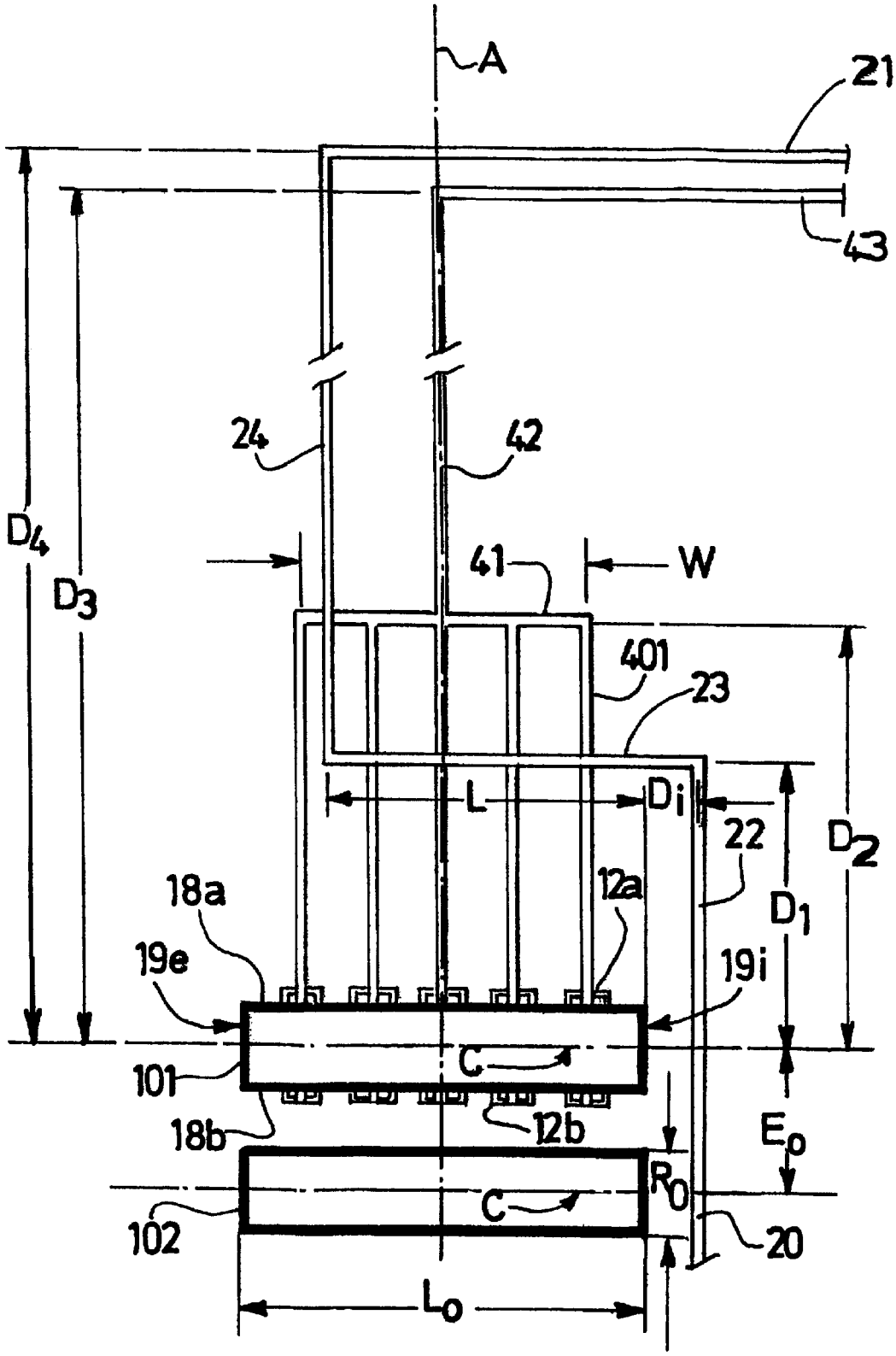
FIG. 3 illustrates an electrolytic cell line end corresponding to FIG. 2.
Figure 5:
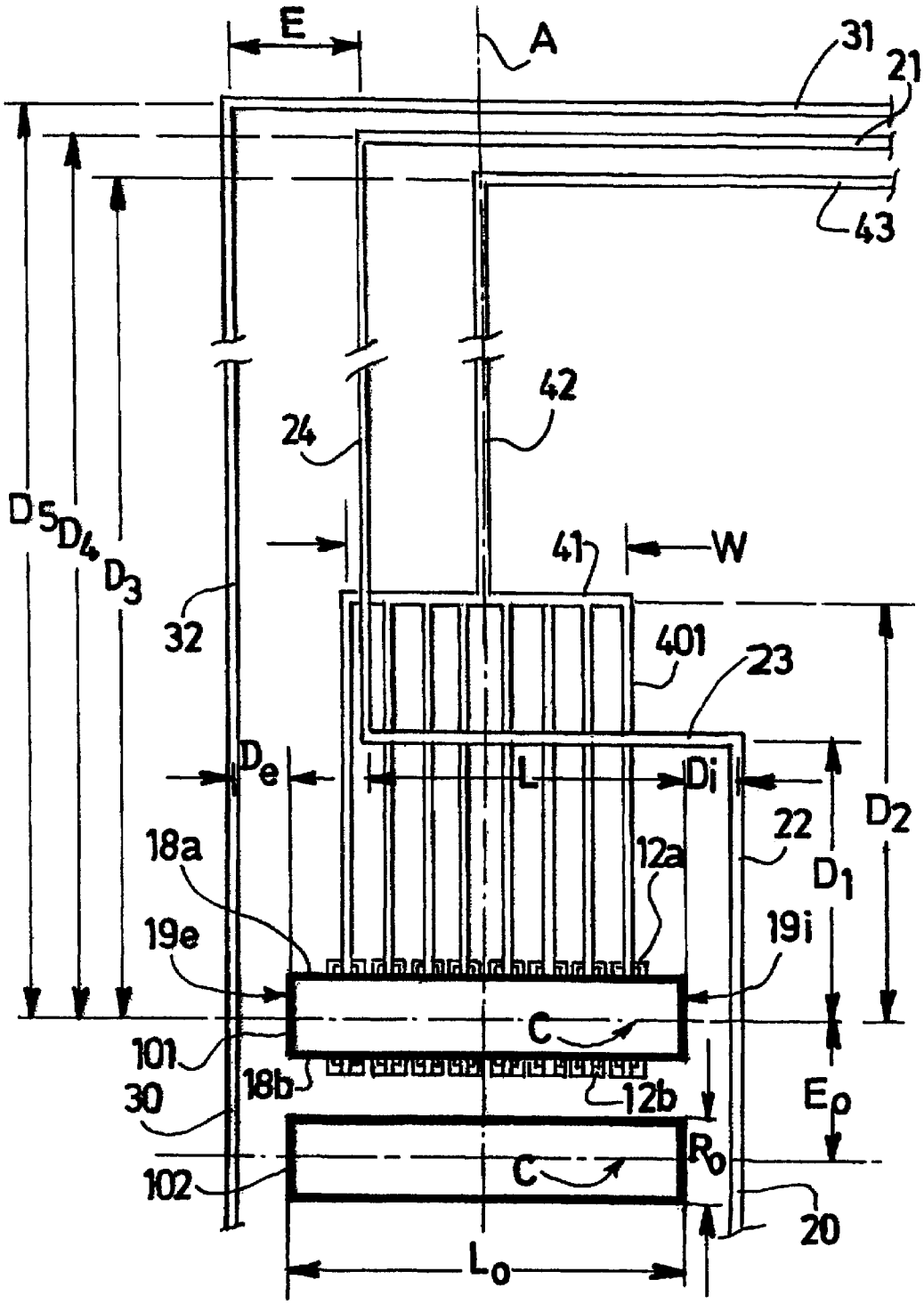
FIG. 5 illustrates an electrolytic cell line end corresponding to FIG. 4.

As illustrated in FIGS. 3 and 5, the determined portion or "fraction" L is calculated using an imaginary line extending from the short internal side 19*i* of the cell. The determined portion L is preferentially greater than 0.5 Lo and more preferentially greater than 0.8 Lo. Each transverse segment 23, 23' advantageously runs along the entire length Lo of the end cell (L is equal to Lo in this case). The term "each" as used in this application should be interpreted to include situations where only one thing is involved (is these situations, "each" also will mean "the") and situations in which more than one thing is involved.

The distances D1 and D1', along with the distances D2 and D2', may be different for each line.

The line which comprises the magnetic field equilibration means according to an embodiment of the invention is said to be "compensated". Preferentially, each line of the series is compensated according to an embodiment of the invention, i.e., each line comprises at least one layer of conductors 40, 40' and the internal correction circuit 200 comprises at least one transverse segment 23, 23' according to an embodiment of the invention.

Said first 20 and second 20' internal correction conductors are preferentially rectilinear and parallel with the longitudinal axis A, A' of the lines in an embodiment of the invention. They are typically located at a determined distance Di from the external side of the cells (i.e. typically at a determined distance Di from the vertical surface of the metal wall of the pot shell). The value of the determined distance Di can be typically less than 1 meter. The correction conductors 20, 20' are typically located at the level of the pots 3.

The main connecting circuit 400, which ensures the electrical continuity between the two lines of cells, typically comprises at least one so-called "transverse" connecting conductor 43 which is preferentially arranged perpendicularly with respect to the longitudinal axis A, A' of the lines and at a determined distance D3 from the end cell 101, 101' of the lines.

Each layer of conductors 40, 40' can be located on the side of the connecting circuit 400 and can cover, preferentially, at least 80%, and more preferentially at least 90%, of the length Lo of the cells 101, 102, . . . 101', 102', . . . . Each layer 40, 40' is advantageously plane. The conductors 401, 401' of each layer 40, 40' are advantageously distributed uniformly (i.e., so as to be parallel and located at the same distance from each other) and, typically, similarly to those of the rising sections 14, 15. The individual conductors 401, 401' of the layer 40, 40' are typically connected to the end cell 101, 101' by longitudinal connecting conductors 12*a*, 12*b* to which conductors 13 from the near long side 18*a* and/or the far long side 18*b* of the cell are connected. Several connecting conductors 11, 12, 13 may be connected to the same individual conductor 401, 401' of the layer.

The main connecting circuit 400, in an embodiment, advantageously comprises at least one joining conductor 41, 41', to which the conductors 401, 401' of the layer 40, 40' are connected. In order to simplify the embodiment of the connecting circuit, each joining conductor 41, 41' is preferentially rectilinear, arranged perpendicularly with respect to the longitudinal axis A, A' of the lines and located at said determined distance D2 and/or D2'. The length of the joining conductor 41, 41' is preferentially substantially equal to the width W of the layer 40, 40'.

Advantageously, the main connecting circuit 400, in an embodiment, also comprises a connecting conductor 42, 42' connected to the joining conductor 41, 41', on one hand, and to the transverse connecting conductor 43, on the other, in order to ensure the electrical continuity between these conductors. The connecting conductor 42, 42' can be preferably longitudinal, i.e., substantially rectilinear and substantially parallel to the longitudinal axis A, A' of the line, and located at a determined distance of said axis. The connecting conductor 42, 42' may be connected to the center of the joining conductor 41, 41', i.e., in the axis of each line, in order to ensure electrical equilibrium of the circuit and maintain the symmetry of the main connecting circuit with respect to the longitudinal axis A, A' of the line. The connection may be located towards the inside or towards the outside of the lines, with respect to the longitudinal axis A, A', in order to create additional compensation asymmetry.

The internal connecting conductor 21 preferentially comprises a so-called "transverse" conductor arranged perpendicularly with respect to the longitudinal axis of the lines A, A' and at a determined distance D4 from the end cell 101, 101' of the lines. In this configuration, the internal correction circuit 200 also comprises intermediate connecting conductors 22, 22', 24, 24', which comprise internal intermediate conductors 22, 22' and external intermediate conductors 24, 24'. The internal intermediate conductors 22, 22' can extend advantageously from the corresponding internal correction conductors 20, 20' and can extend preferentially at least to each determined distance D1 and/or D1'. This embodiment makes it possible to extend the symmetry of the specific conductors for the line and thus limit the perturbations of the magnetic field caused by the interruption in continuity of the series at the end of the line.

The series according to an embodiment of the invention may also comprise if required a so-called "external" correction circuit 300, comprising at least one first external correction conductor 30, located along the first line on the side thereof opposite the second line, one second external correction conductor 30', located along the second line on the side thereof opposite the first line, and one so-called "external" connecting conductor 31. The first 30 and second 30' external correction conductors can be preferentially rectilinear and parallel with respect to the longitudinal axis A, A' of the lines. They are typically located at a determined distance Dc from the external side of the cells. The value of the determined distance De is typically less than 1 meter. The correction conductors 30, 30' are typically located at the level of the pots 3.

The external connecting conductor 31 in an embodiment preferentially comprises a so-called "transverse" conductor arranged perpendicularly with respect to the longitudinal axis of the lines A, A' and at a determined distance D5 from the end cell 101, 101' of the lines. In this configuration, the external correction circuit 30 also can comprise, for each line, at least one external intermediate connecting conductor 32, 32'. These intermediate conductors 32, 32' can extend advantageously from the corresponding external correction conductors 30, 30'. They can extend to the determined distance D5 which is, preferentially, at least equal to each determined distance D1 and/or D1'. This embodiment makes it possible to extend the symmetry of the specific conductors for the line and thus limit the perturbations of the magnetic field caused by the interruption in continuity of the series at the end of the line.

The external intermediate conductors 24, 24' of the internal correction circuit 200 are typically parallel with the intermediate conductors 32, 32' of the external correction circuit 300. These conductors may be separated by a very small distance E, which may be less than 1 meter.

The transverse connecting conductors 21, 31, 43 can be rectilinear in order to simplify their design and limit their cost.

The distances D1 to D5 can be determined with respect to the longitudinal axis, or "main axis", C of the end cell 101, 101' which is located on the side of the connecting conductors.

The distances D3, D4 and D5 and preferentially as large as possible in an embodiment. It was found to be sufficient for the value of these distances to be greater than or equal to determined thresholds S3, S4, S5 in certain embodiments. In fact, for distance values greater than these thresholds, the circuits according to some embodiments of the invention make it possible to compensate for the impact of the additional magnetic field induced by the connecting conductors 21, 31, 43 between lines. The value of the thresholds S3, S4 and S5 can depend on the intensity of the electrolytic current Io, the intensity of the correction currents Ii and Ie, and the value of the total additional magnetic field ΔBz deemed acceptable. The distances D3, D4 and D5 can be typically greater than or equal to 5 times the distance D1, D1' of the transverse segment 23, 23'.

In an embodiment, the distances D3, D4 and D5 are advantageously of the same order of magnitude, i.e., there is very little difference between them (i.e., typically less than 20% with respect to each other, or even less than 10%), in order to simplify the embodiment of the circuits. In this case, the applicant found that the value of the thresholds S3, S4 and S5 was given by the approximate equation $S3=S4=S5\cong K\times Io\times(\Delta Bz/Bo)^{\alpha}$, where K is a constant, α is a constant between −1 and −0.2, ΔBz is given in Gauss and Bo=1 G.

In an embodiment, the determined distance D1, D1' of the transverse segment 23, 23' is selected so as to compensate for the impact of the additional magnetic field induced by the connecting conductors 21, 31, 43 between lines. More specifically, the determined distance D1, D1' can be preferentially such that the additional magnetic field added by all the conductors to the specific field corresponding to an endless line is limited between a maximum value +ΔBz and a minimum value −ΔBz at the level of the end cells of a line, particularly the end cell 101, 101'.

The determined distance in an embodiment, D2, D2', which is typically that of the joining conductor 41, 41', is preferentially at least equal to once the center distance Eo, and more preferentially at least equal to twice the center distance Eo.

In an embodiment, the values of the determined distances D1 and D1' or D2 and D2' are typically substantially the same for each compensated line.

The following examples are set forth as being representative of the present invention. These examples are not to be construed as limiting the scope of the invention as these and other equivalent embodiments will be apparent in view of the present disclosure, figures, tables, and accompanying claims.

Example 1

A calculation simulating a series of at least 200 electrolytic cells formed by two parallel lines separated by a distance Do of approximately 50 m was performed. The electrical circuits had a similar configuration to that in FIGS. 2 and 3. The longitudinal connecting conductors 42, 42' were connected to the center of the corresponding joining conductors 41, 41'. The length of the cells was 15 m. The transverse segment 23, 23' covered the entire length of the last cell (i.e., a fraction L equal to 1). The center distance between the cells was 6 m. The circuit comprises 5 rising sections separated from each other by 2.7 meters. The layer of conductors 40, 40' comprises 5 conductors at intervals of 2.7 meters.

The intensities were as follows: Io=350 kA and Ii=30 kA.

It was determined that K≅0.13 m/kA and α≅−0.44.

It was also noted that, using the following parameters, the intensity of the additional vertical magnetic field ΔBz at the center of the end cells of each line could be made less than 5 Gauss for distances D3, D4 and D5 equal to 24 m, distances D1 and D1' equal to 3.5 m and distances D2 and D2' at least equal to 6 m.

Example 2

A calculation simulating a series of at least 200 electrolytic cells formed from two parallel lines separated by a distance Do of approximately 85 m was performed. The electrical circuits had a similar configuration to that in FIGS. 4 and 5. The longitudinal connecting conductors 42, 42' were connected to the center of the corresponding joining conductors 41, 41'. The length of the cells was 18 m. The transverse segment 23, 23' covered the entire length of the last cell (i.e., a fraction L equal to 1). The center distance between the cells was 6 m. The circuit comprised 8 rising sections separated from each other by 2 meters. The layer of conductors 40, 40' comprised 8 conductors at intervals of 2 meters.

The intensities were as follows: Io=480 kA, Ii=180 kA and Ie=105 kA.

It was noted that, in the absence of magnetic field equilibration means, the mean additional vertical magnetic field ±ΔBz on the first end cells of each line is between 5 and 14 Gauss, in absolute values.

It was determined that K≅0.17 m/kA and α≅−0.58.

It was also noted that, using the following parameters, the intensity of the additional vertical magnetic field ΔBz at the center of the end cells of each line could be made less than 5 Gauss for distances D3, D4 and D5 equal to 32 m, distances D1 and D1' equal to 6 m and distances D2 and D2' at least equal to 6 m.

It was observed that the layer simulated the presence of the cell missing after the end of the lines sufficiently well so that the end cells were not subject to excessive perturbation.

The invention claimed is:

1. A series of electrolytic cells for the production of aluminium by means of fused bath electrolysis according to the Hall-Heroult process comprising:

a plurality of electrolytic cells arranged to form at least one first line of cells and one second line of cells that are rectilinear and parallel with each other, said cells being arranged transversally with the longitudinal axis A, A' of each line with a constant center distance Eo between the cells, each cell having a length Lo;

connecting conductors between the cells of each line;

an internal correction circuit, comprising at least one first internal correction conductor, located along the first line on the side thereof facing the second line, one second internal correction conductor, located along the second line on the side thereof facing the first line, and at least one internal connecting conductor;

a main connecting circuit between the end cell of the first line of cells and the end cell of the second line of cells;

and wherein, for at least one of said lines of cells;

the main connecting circuit comprises at least one layer of conductors wherein each conductor in the at least one layer of conductors is connected to the end cell of the line and extends to a determined distance (D2, D2') therefrom, the internal correction circuit further comprising at least one rectilinear conductor, which is connected to the internal correction conductor, and is arranged perpendicularly with respect to the longitudinal axis A, A' of the line and runs along the end cell of the line of cells, at a determined distance (D1, D1'), over a determined portion L of the length Lo of the end cell.

2. The series of electrolytic cells according to claim 1, wherein the determined portion L is greater than 0.5 Lo.

3. The series of electrolytic cells according to claim 1, wherein the determined portion L is greater than 0.8 Lo.

4. The series of electrolytic cells according to claim 1, wherein each distance (D2, D2') is at least equal to once the center distance Eo.

5. The series of electrolytic cells according to claim 1, wherein each distance (D2, D2') is at least equal to twice the center distance Eo.

6. The series of electrolytic cells according to claim 1, wherein the at least one layer of conductors covers at least 80% of the length Lo of the cells.

7. The series of electrolytic cells according to claim 1, wherein the at least one layer is plane.

8. The series of electrolytic cells according to claim 1, wherein the conductors of each of the at least one layer of conductors are arranged parallel to each other and located approximately at the same distance from each other.

9. The series of electrolytic cells according to claim 1, wherein the main connecting circuit comprises at least one joining conductor, to which the conductors of each of the at least one layer of conductors are connected.

10. The series of electrolytic cells according to claim 9, wherein the joining conductor is rectilinear, arranged perpendicularly with respect to the longitudinal axis A, A' of the line and located at each determined distance (D2, D2').

11. The series of electrolytic cells according to claim 9, wherein the length of the joining conductor is substantially equal to the width W of the at least one layer of conductors.

12. A series of electrolytic cells according to claim 1, wherein the main connecting circuit comprises a transverse conductor arranged perpendicularly with respect to the longitudinal axis A, A' of the lines of cells and at a determined distance (D3) from the end cell of the lines.

13. The series of electrolytic cells according to claim 12, wherein the main connecting circuit comprises at least one joining conductor, to which the conductors of the at least one layer of conductors are connected, and in that each joining conductor is rectilinear, arranged perpendicularly with respect to the longitudinal axis A, A' of the lines and located at said determined distance D2 and/or D2'.

14. The series of electrolytic cells according to claim 13, wherein the main connecting circuit further comprises a connecting conductor connected to the joining conductor, and to the transverse connecting conductor to ensure the electrical continuity between the conductors, and wherein the connecting conductor is rectilinear, parallel with the longitudinal axis A, A' of the line and located at a determined distance of said axis.

15. The series of electrolytic cells according to any claim 1, wherein the internal connecting conductor comprises a transverse conductor arranged perpendicularly with respect to the longitudinal axis of the lines A, A' and at a determined distance (D4) of the end cell of the lines.

16. The series of electrolytic cells according to claim 1, further comprising an external correction circuit, including at least one first external correction conductor, located along the first line on the side thereof opposite the second line, at least one second external correction conductor, located along the second line on the side thereof opposite the first line, and at least one external connecting conductor.

17. The series of electrolytic cells according to claim 16, wherein the external connecting conductor comprises a transverse conductor arranged perpendicularly with respect to the longitudinal axis of the lines A, A' and at a determined distance (D5) from the end cell of the lines.

18. A series of electrolytic cells for the production of aluminium by means of fused bath electrolysis according to the Hall-Heroult process comprising:

a plurality of electrolytic cells arranged to form at least one first line of cells and one second line of cells that are rectilinear and parallel with each other, said cells being arranged transversally with the longitudinal axis of each line;

a connecting conductor between a cell in the first line and a cell in the second line; and an internal correction circuit, comprising at least one first internal correction conductor located along the first line on the side thereof facing the second line, and at least one second internal correction conductor located along the second line on the side thereof facing the first line, and at least one internal connecting conductor, and further comprising at least one rectilinear conductor which is arranged perpendicularly with respect to the longitudinal axis of the first line and is connected to said at least one internal connecting conductor.

19. The series of electrolytic cells according to claim 18, wherein said at least one rectilinear conductor crosses at least one conductor connected to an end cell of said at least one first line of cells.

20. A series of electrolytic cells for the production of aluminium by means of fused bath electrolysis according to the Hall-Heroult process comprising:

a plurality of electrolytic cells arranged to form at least one first line of cells and one second line of cells that are rectilinear and parallel with each other, said cells being arranged transversally with the longitudinal axis of each line;

connecting conductors between the cells of each line; and an internal correction circuit, comprising at least one first internal correction conductor, located along the first line on the side thereof facing the second line, at least one second internal correction conductor located along the second line on the side thereof facing the first line, and at least one internal connecting conductor, and further comprising at least one rectilinear conductor which is arranged perpendicularly with respect to the longitudinal axis of the line and is connected to said at least one internal connecting conductor, and said at least one rectilinear conductor overlaps at least one conductor connected to an end cell of said at least first line of cells.

* * * * *